US005545076A

United States Patent [19]

Yun et al.

[11] Patent Number: 5,545,076

[45] Date of Patent: Aug. 13, 1996

[54] APPARATUS FOR GRINGING A SEMICONDUCTOR WAFER WHILE REMOVING DUST THEREFROM

[75] Inventors: Tae-Jin Yun; Dong-Pyo Hong, both of Yongin; Byung-Suk Park, Suwon, all of Rep. of Korea

[73] Assignee: Samsung Electronics Co., Ltd., Suwon, Rep. of Korea

[21] Appl. No.: 440,920

[22] Filed: May 15, 1995

[30] Foreign Application Priority Data

May 16, 1994 [KR] Rep. of Korea ..... 94-10655

[51] Int. Cl.[6] ..... B24B 5/00

[52] U.S. Cl. ..... 451/287; 451/41; 451/285; 451/450; 156/636.1; 156/645.1; 437/228; 134/902; 134/153; 134/148

[58] Field of Search ..... 451/36, 41, 60, 451/285, 287, 288, 289, 444, 450, 446; 156/636.1, 645.1; 148/DIG. 17; 437/228, 946; 134/902, 199, 153, 148, 149

[56] References Cited

U.S. PATENT DOCUMENTS

| | | | |
|---|---|---|---|
| 3,342,652 | 9/1967 | Reisman et al. | 156/636.1 |
| 4,064,885 | 12/1977 | Dussault et al. | 134/148 |
| 4,092,176 | 5/1978 | Kozai et al. | 134/902 |
| 5,320,706 | 6/1994 | Blackwell | 134/902 |
| 5,348,033 | 9/1994 | Levit | 134/902 |
| 5,384,986 | 1/1995 | Hirose et al. | 451/444 |
| 5,483,717 | 1/1996 | Chikaki | 134/902 |

FOREIGN PATENT DOCUMENTS 142067 6/1989 Japan .

*Primary Examiner*—Bruce M. Kisliuk
*Assistant Examiner*—Eileen P. Morgan
*Attorney, Agent, or Firm*—Cushman Darby & Cushman, L.L.P.

[57] ABSTRACT

An apparatus for polish-grinding a semiconductor wafer which assuredly removes contaminant dusts from the polished wafer includes a grinding device for polishing a surface of the wafer. The grinding device has a chuck table on which the wafer is laid, a grinding wheel for grindingly polishing the wafer, and means for supplying water to the wafer. The means for supplying water provides water to region of contact between the grinding wheel and the wafer. The apparatus also includes a cleaning device for cleaning any remaining dust on the wafer, having a spin chuck table for rotating the polished wafer, means for supplying a detergent to the polished wafer. The means for supplying the detergent injects the detergent on the surfaces of the polished wafer. The apparatus also includes a controller for controlling the grinding device and the cleaning device. Accordingly, the apparatus according to the present invention can prevent dust from being suctioned to the front side of a wafer, and can remove dust during and after a wafer-grinding process.

8 Claims, 2 Drawing Sheets

APPARATUS FOR GRINGING A SEMICONDUCTOR WAFER WHILE REMOVING DUST THEREFROM

BACKGROUND OF THE INVENTION

1.Field of the Invention

The present invention relates to an apparatus for polishing-grinding a semiconductor wafer.

More particularly, this invention relates to an apparatus for grinding a semiconductor wafer which can easily remove dusts produced by the grinding process.

2. Description of Related Art

In general, semiconductor wafers are obtained from silicon ingots by slicing, grinding, chemical etching, and polishing. Grinding processes are classified into single-side grinding and dual-side grinding. The single-side grinding method is used to grind a backside of semiconductor wafers so that the wafer are in a suitable condition for gold deposition and assembly. By grinding the backside of semiconductor wafers, unnecessary films on the wafers can be controlled so as to be suitable for subsequent processing. According to this grinding process, a mixture of an abrasive and a lapping vehicle is put between a lapping plate and the semiconductor wafer, and then a rubbing force is applied to the wafer. The lapping plate and wafer are polished by the action of the abrasive and the lapping vehicle so that the surface of the wafer is smoothed.

It is particularly important in the grinding process to minimize the generation of dust contaminants. For example, during the slicing process or the grinding process, particulate dust, including abrasive material, iron, crushed silicon, etc. is created. Such dust negatively affects the gold deposition process. Therefore, the surface of the wafer should be smoothed while also removing such dust, and the surface of the crystalline silicon should be cleansed by removing contaminants from the crystalline silicon surface. A washing process in the semiconductor fabrication process is also important. By using a washing process, adhesives used in the grinding process, photosensitive films for protecting a front surface of a wafer, and any other unnecessary or undesirable elements can be removed.

Referring the accompanied drawings, FIGS. 1(A), 1(B), and 2 illustrate a known apparatus for grinding a backside of semiconduct wafers.

FIG. 1A is a view of a conventional apparatus for grinding semiconductor wafers. FIG. 1B illustrates a condition in which silicon and other dusts are transmitted to an edge side of the view of a wafer-cleaning part of a conventional polishing apparatus.

The conventional wafer-grinding apparatus is described hereinbelow.

A chemical/mechanical grinding step is used to produce a highly reflective surface without scratches or other damages on one side of a semiconductor wafer. According to a conventional grinding process for grinding a wafer 3, a wafer 3 having a frontside thereof covered with a protective tape is put, frontside down, on a vacuum chuck table 2. The backside of the wafer 3 is polished by a grinding wheel 1 which has a known thickness. If the wafer 3 has a proper thickness and surface, the tape of the front side of the wafer 3 may be removed. During the above-described grinding process, silicon and other dusts 102 (represented by radiating arrows in FIG. 1A) are produced. Since the dust 102 prevents proper polishing of the surface of the wafer 3, dust 102 must be removed.

As shown in FIG. 1A, the conventional grinding apparatus uses a water jet 101 during grinding. After the grinding step, the conventional apparatus cleans dust 102 and then dries the wet wafer. In addition, water jet 101 flows water from the grinding wheel 1 to the side if the wafer 3 being polished, so dust 102 is carried in the stream of water 101 from the center portion of the wafer 3 to the edge thereof, as seen at 103 in FIG. 1B.

As shown in FIG. 2, the wafer 3 is then put on a spin chuck table 4 so that the frontside of the wafer 3 is opposite to the spin chuck table 4. Dust from the wafer 3 are entrained in the inflow of water 201. Such an apparatus includes a final drying step.

Only one method for supplying water is typically used to flow washing water in the conventional apparatus. With the inflow of water 101, dust 102 naturally spreads over one side of the wafer 3, and it migrates to the opposite side of the wafer 3 because of the vacuum action of the chuck table 2. Consequently, large amounts of dust tend to migrate to the front-side of the wafer 3, and it is difficult to remove this dust from the frontside. Moreover, washing water 201 only flows over the back-side of the polished wafer 3 in order to clean it. Therefore, dust remains on the frontside of the wafer 3, even though the cleaning process is performed.

In the case of a 6" inch semiconductor wafer, for example, the amount of dust which remains on the frontside of the semiconductor wafer after cleaning step is not usually problematic.

However, since wafers have become larger recently (for example, 8" inches), the amount of resultant remaining dust can increase by two or three times. In addition, a remover tape is used to remove a coating tape which was stuck on the frontside of the wafer before grinding. The remover tape is weakly adhered because of the increased amount of dust on the front of the wafer. After all, it is disadvantageous that the wafer is broken and occurs an error in sticking a remover tape on the coating tape.

SUMMARY OF THE INVENTION

Accordingly, the objectives of the present invention include providing an apparatus for grinding a semiconductor wafer which can easily remove resultant grinding and abrasive dusts, and thereby improved the adhesion capability of a subsequently applied remover tape.

In order to realize the above objectives, an apparatus for grinding a semiconductor wafer in accordance with the present invention is provided comprising:

- a polishing device for smoothing a surface of a wafer, including a chuck table on which the wafer is laid, a grinding wheel for grinding the wafer, and a grinding water supply, wherein grinding water supply provides additional grinding water to a frictional position between said grinding wheel and said wafer and the other position of the wafer;
- a cleaning device for removing dust on the wafer, including a spin chuck table for rotating the smoothed semiconductor wafer, a detergent supply providing a detergent to the smoothed wafer, wherein the detergent supply injects detergent on both sides of the smoothed wafer;
- a controller for controlling the grinding device and the cleaning device;
- a carrier for conveying a smoothed wafer from the grinding device to the spin chuck table of the cleaning device after the grinding step; and a grinding water tank for providing grinding water.

The full scope and applicability of the present invention will become apparent from the detailed description given hereinafter.

However, it should be understood that the detailed description and specific examples, while indicating a preferred embodiment of the invention, are given by way of illustration only, since various changes and modifications within the spirit and scope of the disclosed invention will become apparent to those skilled in the art from this detailed description.

DETAILED DESCRIPTION OF THE PREFERRED EMBODIMENT

Hereinafter, a preferred embodiment of the present invention will be described in detail with reference to the accompanying drawings.

Figure 3:
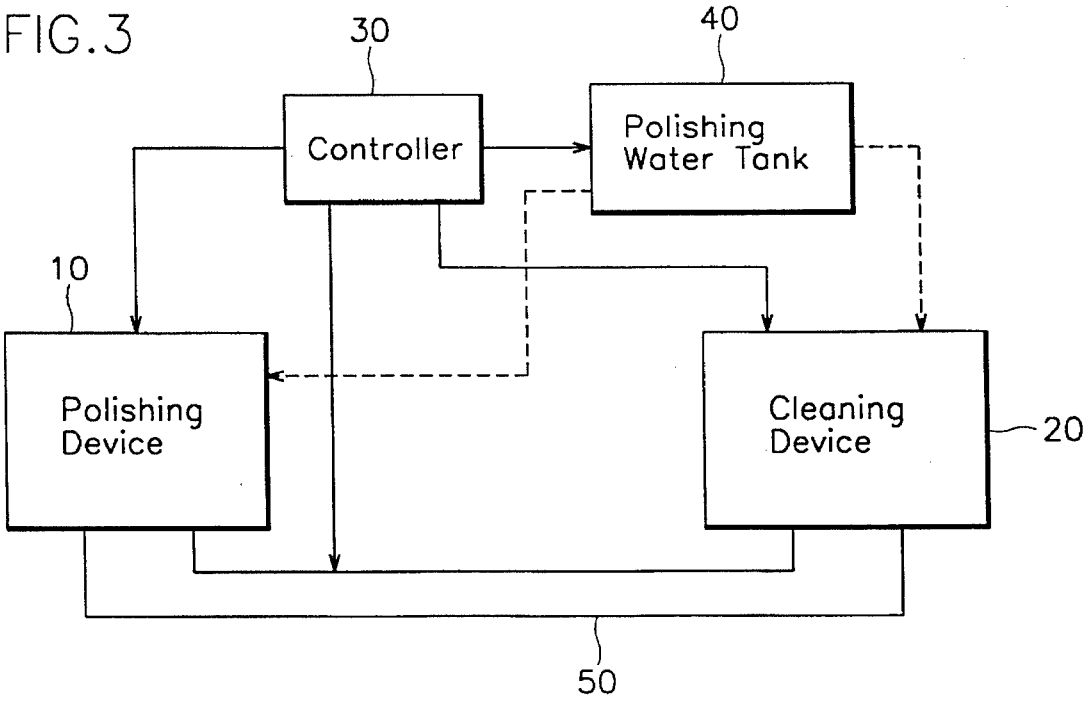
FIG. 3 is a block diagram of a wafer-grinding apparatus according to the present invention.
Figure 4A:
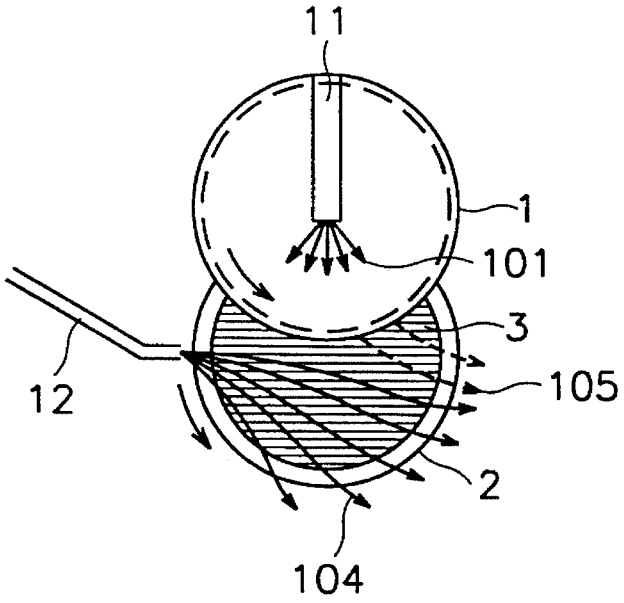
FIG. 4A is a plan view of grinding device of a wafer-polishing apparatus according to the present invention.
Figure 4B:
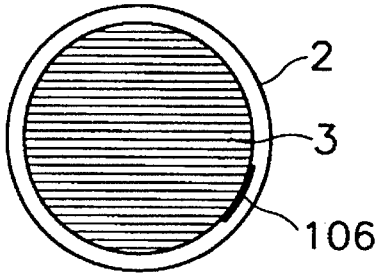
FIG. 4B shows a portion of dust which has migrated to the front edge of a wafer during grinding thereof, in a polishing apparatus according to the present invention.
Figure 5:
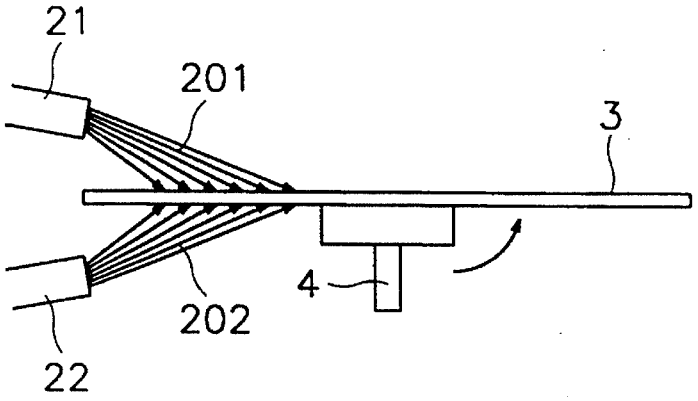
FIG. 5 is a side view of a cleansing device in a wafer-grinding apparatus according to the present invention.

As shown in FIG. 3 to FIG. 5, a wafer-polishing apparatus which can remove dust according to the present invention, includes a polishing device 10 for smoothing a surface of a wafer and moving resultant dust 105 to a predetermined position. The polishing device 10 includes a vacuum chuck table 2 on which the wafer 3 is mounted, a grinding wheel 1 to perform the grinding process, and two of more water-carrying conduits for supplying grinding water flows 11 and 12, which are connected to, for example, a grinding water supply tank 40.

Cleaning device 20 has two detergent-carrying conduits 21, 22 for supplying detergent flows 201, 202 simultaneously to upper and lower surfaces of the wafer 3 in order to remove any remaining dust 105 from the wafer 3. A carrier 50 (schematically illustrated in FIG. 3) conveys and sets a wafer 3 from vacuum chuck table 2 to spin chuck table 4 after grinding. A controller controls the grinding device 10, the carrier 50, and the cleaning device 20. A grinding water tank 40 provides grinding device 10 and cleaning device 20 with water through conduits 11, 12, 21, 22.

A process for removing dust from a polished semiconductor wafer according to the present invention is as follows.

Figure 1A:
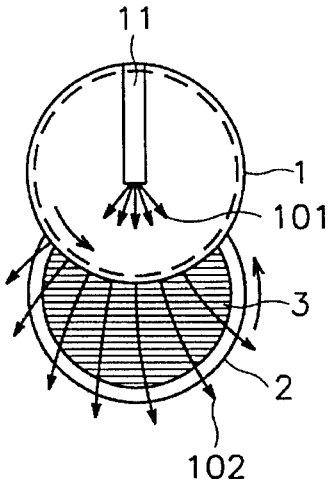
FIG.1A(Prior Art)
FIG. 1A is a plan view of a conventional polishing device for grinding a semiconductor wafer.
Figure 1B:
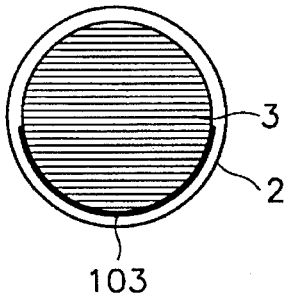
FIG.1B(Prior Art)
FIG. 1B illustrates dust which has migrated to a front edge of a wafer during the grinding thereof in a conventional grinding apparatus.
Figure 2:
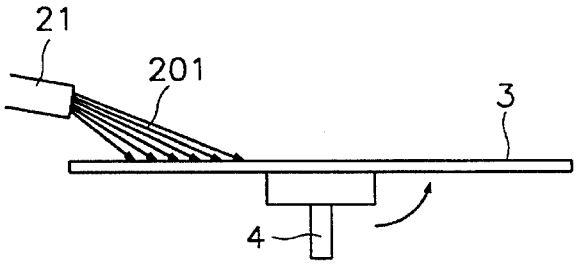
FIG.2(Prior Art)
FIG. 2 is a detailed view of a cleaning device in a conventional wafer-grinding apparatus.

Referring to FIG. 1A, in a conventional after-grinding apparatus, dust 102 is spread on surface of wafer 3 only by grinding water flow 101. However, according to the present invention, as seen in FIG. 4A, a grinding water flow 104 is provided in the grinding device 10, in addition to grinding water flow 101. Thus, the flowing dust 105 in FIG. 4A is changed in direction from that of flowing dust 102 in FIG. 1A.

Consequently, as shown in FIG. 4B, the portion of the wafer 3 which is contaminated with dust will be reduced to the region 106. Therefore, the dispersal of remaining dust on the frontside of the polished wafer 3 is drastically diminished. Referring to FIG. 5, the polished wafer 3 is subsequently carried to spin chuck table 4, and is put on the spin chuck table 4 so that it contacts the frontside of the coated wafer 3. Then, as shown in FIG. 5, both the front and backsides of the wafer 3 are cleansed by the inflows of detergent 201, 202 flow through the conduits for supplying detergent for the frontside 22 and the backside 21, respectively. Therefore, dust on the frontside and the backside of the wafer 3 are removed.

Additionally, in the polishing device 10, the wafer 3 is coated, before grinding the backside, with a tape (not shown) so that the frontside of wafer 3 is protected against dust contaminants.

After grinding the backside of the wafer 3, a remover tape is adhered to the protective tape which is coated on the frontside of the wafer 3 so that the protective tape can be removed from the wafer by being adhered to the remover tape as the remover tape is removed from the wafer 3. At this time, since the dust on the frontside of the wafer 3 has been mostly removed by the grinding device 10 and the cleaning device 20, the remover tape adheres well to the surface of the protective tape on wafer 3. Therefore, the protective tape for protecting the frontside of the wafer 3 can be easily removed by being adhered to the remover tape as the remover tape is removed.

According to the present invention, contaminant dust can be better removed from a wafer 3 using, in part, an additional conduit 12 for supplying a grinding water flow 104 to an edge of wafer 3. Consequently, it is possible to largely prevent dust from being suctioned from the backside of wafer 3 to the frontside thereof. It is also possible to better remove dust from the frontside of the wafer by additionally flowing a detergent-supplying conduit 22. Therefore, the present invention is suitable for the field of the fabricating a silicon wafer used as a substrate of a semiconductor device.

What is claimed is:

1. A polishing apparatus comprising:

a wafer-polishing device for polishing a semiconductor wafer, said wafer-polishing device including at least two fluid supply paths for providing at least two fluid flows having different directions to the semiconductor wafer;

a wafer-cleaning device for providing a fluid flow to each of an upper surface and a lower surface of the semiconductor wafer; and a wafer-conveying device for conveying a semiconductor wafer from said wafer-grinding device to said cleaning device.

2. A polishing apparatus as claimed in claim 1, further comprising a fluid supply tank connected at least one of said wafer-polishing device and said wafer-cleaning device.

3. A polishing apparatus as claimed in claim 1, further comprising a controller unit operatively connected to said wafer-polishing device and said wafer-cleaning device.

4. A polishing apparatus as claimed in claim 1, wherein said wafer-cleaning device comprises a chuck table on which the semiconductor wafer is laid.

5. A polishing apparatus as claimed in claim 1, wherein water is provided to said wafer-polishing device and said wafer-cleaning device.

6. A polishing apparatus as claimed in claim 1, wherein a detergent solution is provided to said wafer-cleaning device.

7. A polishing apparatus as claimed in claim 1, wherein said wafer-cleaning device comprises a rotatable chuck table on which the semiconductor wafer is laid.

8. A polishing apparatus as claimed in claim 1, wherein said wafer-polishing device includes a grinding wheel, wherein said grinding wheel can contact the semiconductor wafer, wherein said at least two fluid supply paths supply fluid to at least part of a location at which said grinding wheel contacts the semiconductor wafer.

* * * * *